US008317540B2

(12) United States Patent
Chen

(10) Patent No.: US 8,317,540 B2
(45) Date of Patent: Nov. 27, 2012

(54) COAXIAL CONNECTOR WITH SHIELDING SHELL

(76) Inventor: Shih-Chieh Chen, Taipei (TW)

( * ) Notice: Subject to any disclaimer, the term of this patent is extended or adjusted under 35 U.S.C. 154(b) by 148 days.

(21) Appl. No.: 12/903,229

(22) Filed: Oct. 13, 2010

(65) Prior Publication Data

US 2012/0094529 A1 Apr. 19, 2012

(51) Int. Cl.
*H01R 9/05* (2006.01)

(52) U.S. Cl. ..... 439/582

(58) Field of Classification Search ..... 439/582, 439/63, 585, 581
See application file for complete search history.

(56) References Cited

U.S. PATENT DOCUMENTS 7,025,598 B2 * 4/2006 Ikeda ..... 439/63
7,186,142 B2 * 3/2007 Nagata et al. ..... 439/582
7,351,067 B2 * 4/2008 Chen et al. ..... 439/63
7,367,840 B2 * 5/2008 Chen et al. ..... 439/581
7,762,841 B2 * 7/2010 Ho ..... 439/582
7,874,870 B1 * 1/2011 Chen ..... 439/582
7,950,959 B2 * 5/2011 Chen ..... 439/582
8,047,871 B2 * 11/2011 Kohnishi et al. ..... 439/582

* cited by examiner

*Primary Examiner* — Xuong Chung Trans
(74) *Attorney, Agent, or Firm* — Chun-Ming Shih

(57) ABSTRACT

The present invention relates to a coaxial connector, more particularly relates to a coaxial connector with shielding shell that comprises a main body, a flat portion connected to the main body and a wire holder on the rear end of the flat portion. The main body includes a pair of holding arms and a receiving hole for receiving the cylinder portion of the insulating housing. The flat portion has a front end and a back end, the front end receives the cylinder portion and supports the main body after the main body being bent toward to the flat portion, and there is a cavity formed in the center of the back end through bending over a cover plate, the bending arms bend inward to cover the insulating housing and holding arms from outside.

8 Claims, 8 Drawing Sheets

COAXIAL CONNECTOR WITH SHIELDING SHELL

BACKGROUND OF THE INVENTION

1. Field of the Invention

The present invention relates to a coaxial connector, more particularly relates to a coaxial connector with shielding shell.

2. Description of the Prior Art

A coaxial connector is mainly used to connect cable and electron device for radio-frequency (RF) signal transmission, but it will cause interfering signal during transmission, so shielding shell play an important role to avoid the interference. Relevant existing technology, please refer to Chinese patent CN 01264762.4. Please refer to the figures of this patent, the figures show that the coaxial connector is composed of five parts, including an insulating housing 10, terminals 30 laying in the insulating housing, a shielding shell 50, a coaxial cable holding device 60 and a coaxial cable, the shielding shell 50 holds the insulating housing from outside, the holding device 60 holds the braid of the coaxial cable, and the holding device 60 be fixed to the shielding shell 50 during assembly process. The advantage of this structure is that it can simplify the structure of same parts of the coaxial connector by applying separated design on shielding shell 50 and holding device 60, but it needs two molds to perform it, it will increase the production costs. Furthermore, this kind of coaxial connector is small, and assembly many times will not be conducive to improve production efficiency and control for cost saving.

For this reason, people have developed a new generation of coaxial connector, please refer to Chinese patent CN 200720118251.5, please refer to the figures of this patent, the figures show that the coaxial connector including an insulating housing 1, central terminals 2, a shielding shell 3, and a coaxial cable 4. The shielding shell 3 comprise a main body 31, a flat portion 32 and a wire holder, a pair of holding arms 312 extend longitudinally from the rear of the main body 31 for holding the insulating housing, a fixed piece 314 on the lower end of the holding arms 312 can go through the bottom of the flat portion 32, a pair of side arms extend from the rear end of the flat portion 32, a tail section 325 extend backward from the end of the side arms, and there are a first wire holder 54 and a second wire holder 55 on the rear of the flat portion 32, a fixed piece 314 can be bent to the back of the flat portion 32, so as to join the main body 31 and the flat portion 32 together, the side arms bend inward covering the insulating housing from outside, at last the wire holder of the flat portion 32 fix the tail section 325 of the side arms and the coaxial cable 4 together. Although this kind of once molding formed shielding shell can solve the above mentioned problem, such as need of more molds and assembly difficulty, but it used a more complex scheme so the mold is also complicated in structure, and also, the assembly process is more complex, this will not help to reduce production cost too.

So, the inventor of the present invention searches and creates a solution capable to make up the shortfalls of existing technology.

SUMMARY OF THE INVENTION

A main object of the present invention is to provide a coaxial connector with shielding shell, make a cavity on the shielding shell through bending over a cover plate, to let the cable connecting operation be easier.

Another object of the present invention is to provide a coaxial connector with shielding shell, through simplifying the structure of the mold by use of one-time-molding techniques, reduce the number of rejects and seconds that produced in the assembly or manufacture process.

In order to achieve the above-mentioned object, the present invention provide a coaxial connector with shielding shell, the shielding shell is once stamping formed from a sheet metal, including a main body, a flat portion connected to the main body and a wire holder on the rear end of the flat portion.

The main body comprises a shape of a column, a receiving hole for receiving the cylinder portion of the insulating housing, a pair of holding arms extend longitudinally from both bottom sides of the main body in the direction perpendicular to the longitudinal direction of the main body, a tail portion of the holding arms turns inward and forms a block portion, it can prevent the insulating housing from moving forward, and there are two notches on the bottom of the main body, this two notches can match the two projecting portion of the insulating housing tightly.

The flat portion includes a front end and a back end. The front end is slightly wider than the back end and can receive the cylinder portion and support the main body after the main body bent toward to the flat portion, and there are ribs on both side of the front end to prevent the main body from moving. The back end can receive the holding arms of the main body and the receptacle housing of the insulating housing. And there is a cavity formed in the center of the back end corresponding to the through-hole of the insulating housing. And there is a cavity formed in the center of the back end through bending over a cover plate, the cover plate can seal the cavity for further reduce Electromagnetic Interference (EMI). A pair of side arms extends vertically from the both bottom sides of the back end; the side arms cover the holding arms tightly from outside and combine the ribs of the front end into a whole for extra strength for the flat portion. The pair of side arms extend over and form the bending arms, the bending arm form a "Z" shape, it bend inward and cover the insulating housing and the holding arms from outside. The inclined plane in the middle of the bending arms can match the sloping surfaces of the insulating housing, but the others both sides of the bending arms is flat. The advantage of this design is, when a central conductor with larger diameter need to connect to the wire holder, so need to increase the height of the receptacle housing, it can decrease the consumption of insulating material. The wire holder is formed at the other end of the back end, including first wire holder and second wire holder.

DETAILED DESCRIPTION OF THE INVENTION

Figure 1:
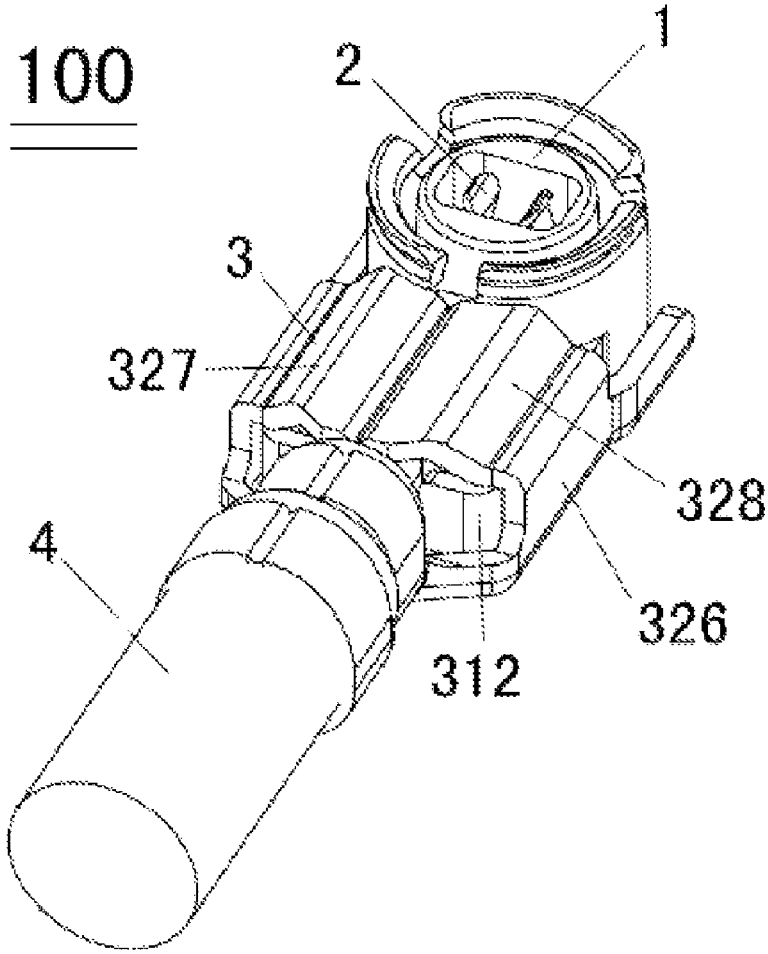
FIG. 1 is a structural representation view of the present invention coaxial connector.

Reference will now be made to the drawing to describe the present invention in detail.

Please refer to FIG. 1, it is a one embodiment of the present invention. A coaxial connector includes an insulating housing 1, central terminals 2 received in the insulating housing 1, a shielding shell 3 covers the insulating housing 1 form outside, and a coaxial cable 4.

Figure 2:
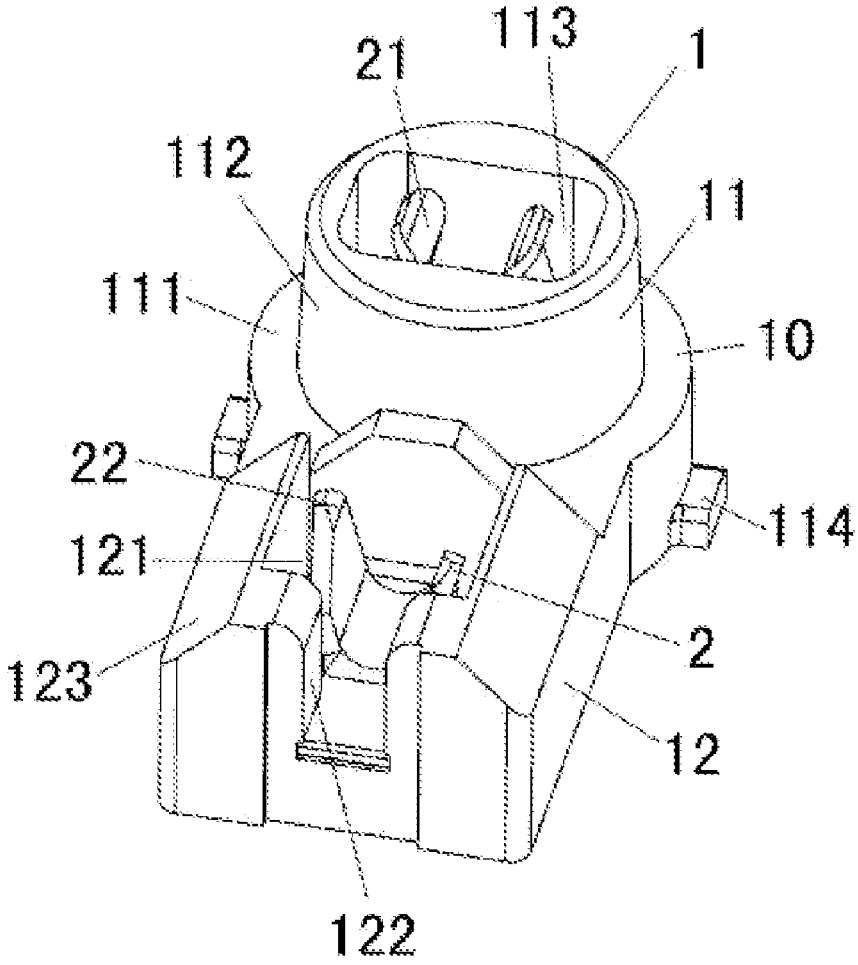
FIG. 2 is a structural representation view of the insulating housing and the center terminal after molding.

Please refer to FIG. 2, the insulating housing 1 and the central terminals 2 formed a docking assembly by insert molding, or it can be formed through assembly process, the insulating housing 1 comprise a cylinder portion 11 and a receptacle housing 12, the cylinder portion 11 comprises a base seat 111 and a hollow tubular shell 112 protruding upward form the base seat 111 and being concentric with the base seat, the hollow tubular shell 112 has a hollow portion 113 for receiving the contact 21 of the central terminal 2, the hollow portion 113 extends through the whole cylinder portion 11, two projecting portion 114 extend in opposite directions from the both side of the base seat 111 symmetrically. The receptacle housing 12 combines the base seat 111 into a whole, and their bottom is in the same plane. There is a through hole 121 in the central portion of the receptacle housing 12 for receiving the wire holder that formed at the end of the central terminal 2, and the through hole 121 has proper size so that it can hold the cable easily. There is a notch 122 at the back end of the through hole 121, the size of the notch 122 is slightly larger than the diameter of central conductor 41 of the coaxial cable 4, but slightly smaller than the diameter of the first layer of the cable 42 which surrounding the cable 42 concentrically, so as to control the length of the central conductor 41 and make the notch 122 match the central conductor 41 in accurate position. An inclined plane 123 formed on top of the receptacle housing 12 and on both sides of the through holes 121.

Figure 3:
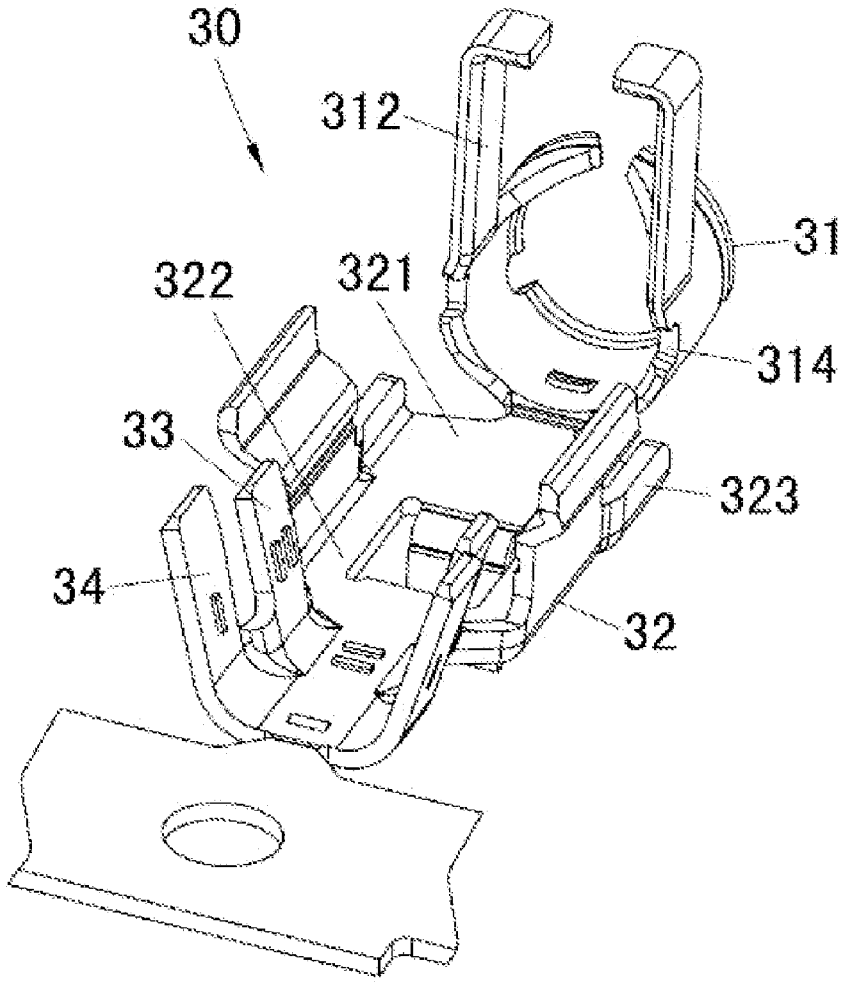
FIG. 3 is a structural representation view of the shielding shell with material belt before bending it.
Figure 4:
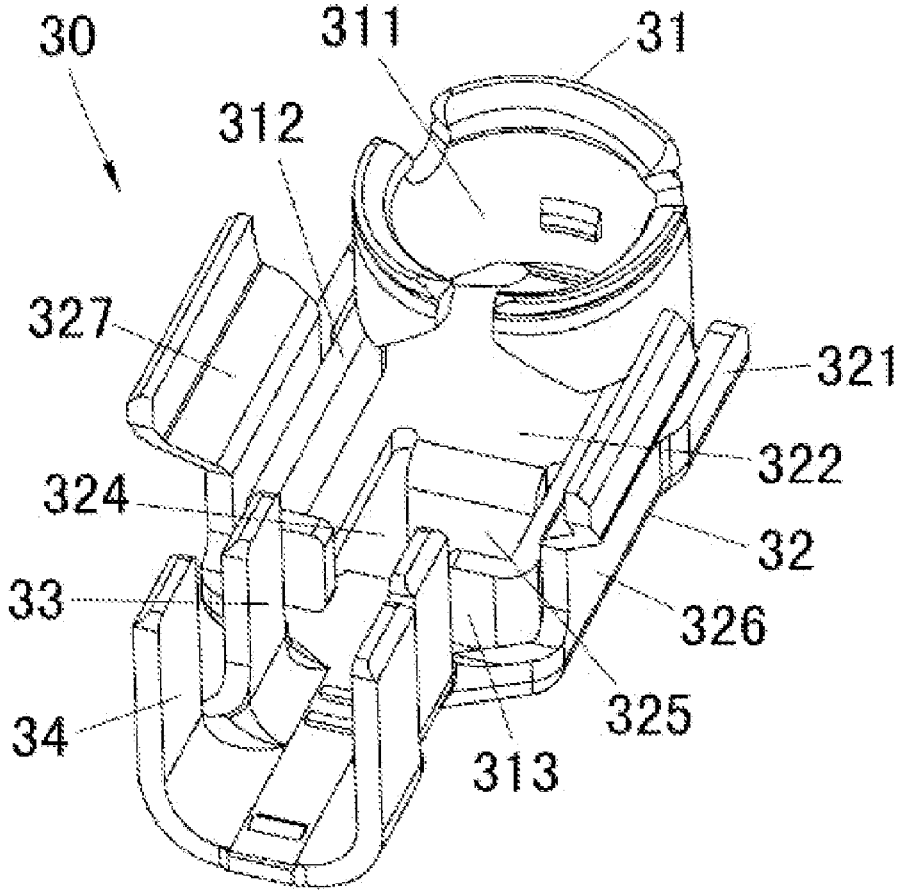
FIG. 4 is a structural representation view of the shielding shell after bending it.
Figure 5:
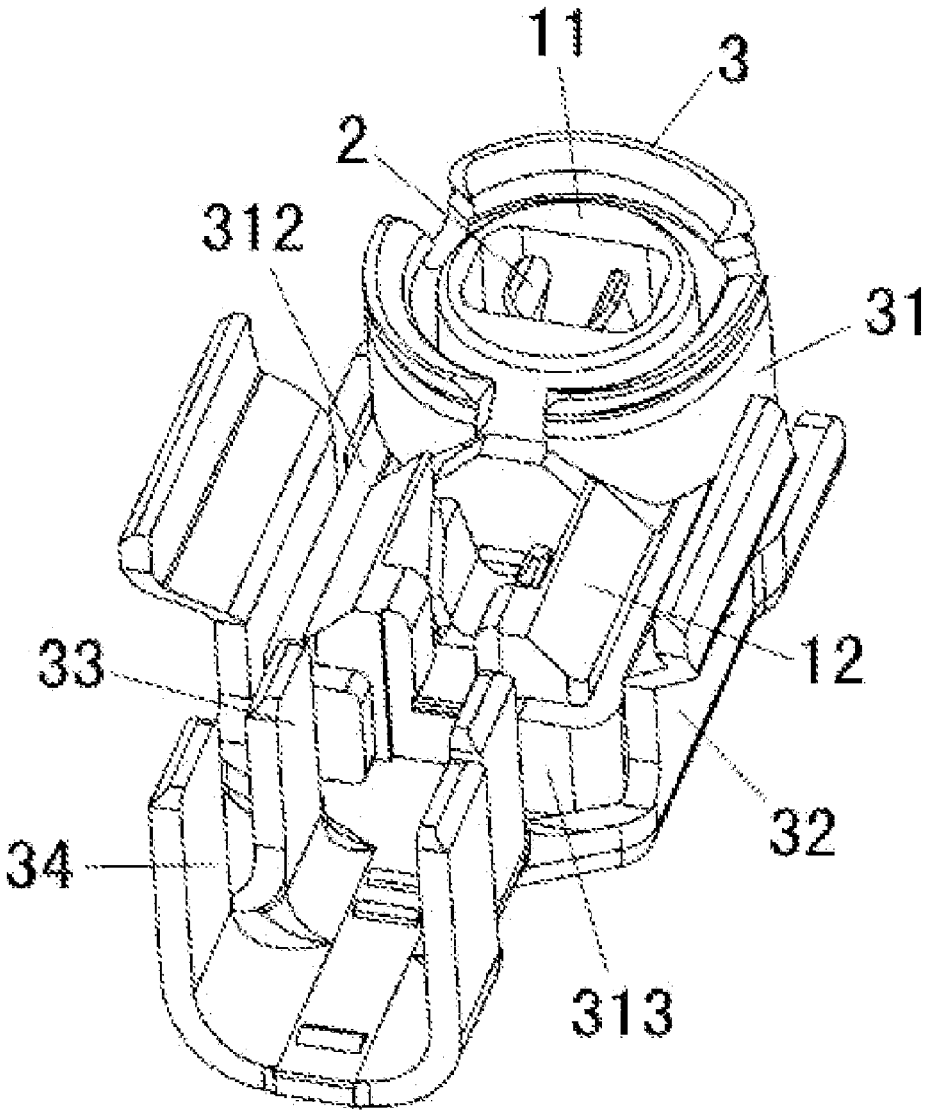
FIG. 5 is a structural representation view of the shielding shell assembled into docking assembly.
Figure 6:
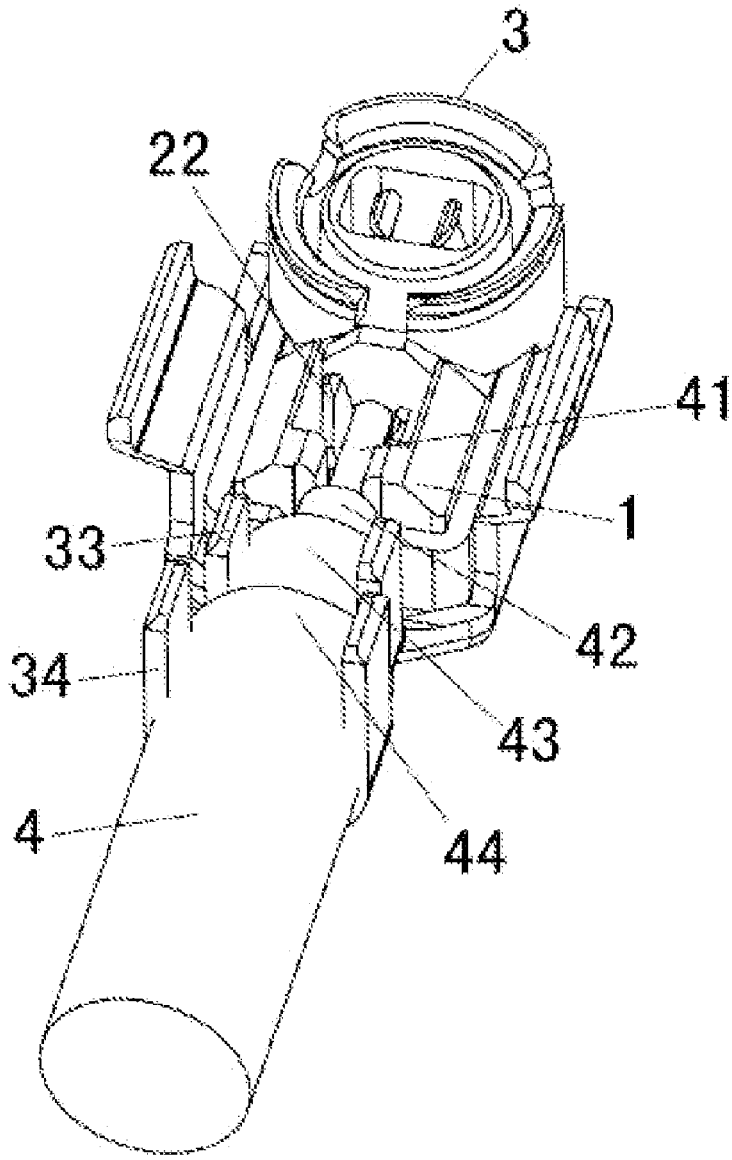
FIG. 6 is a structural representation view of assemble the coaxial cable.
Figure 7:
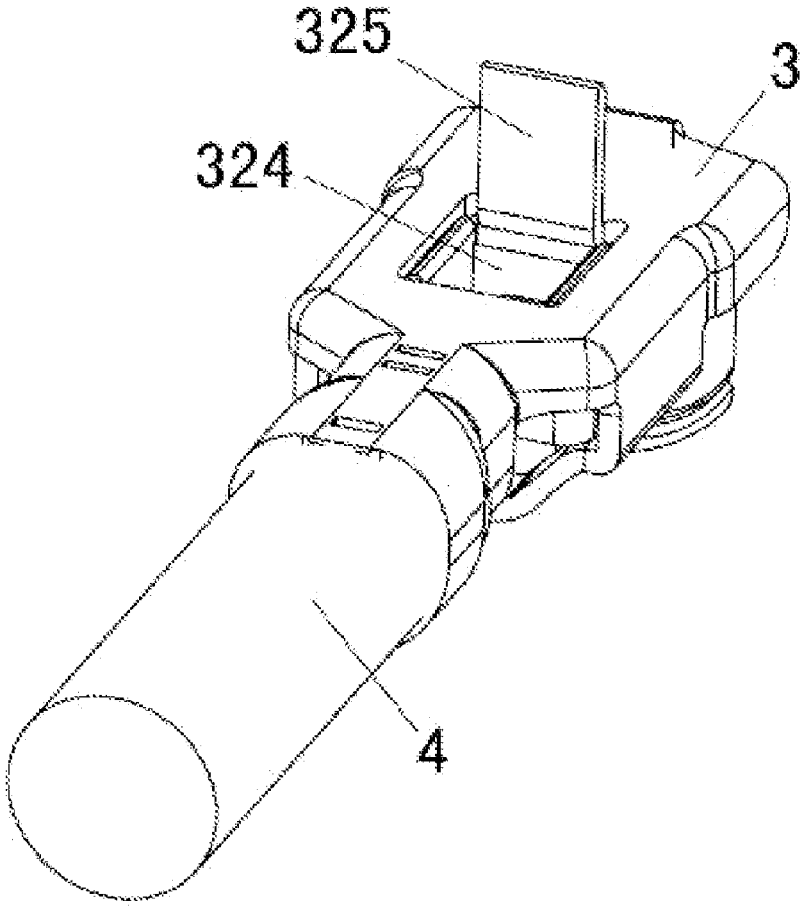
FIG. 7 is a structural representation view of the cover plate before bending it.
Figure 8:
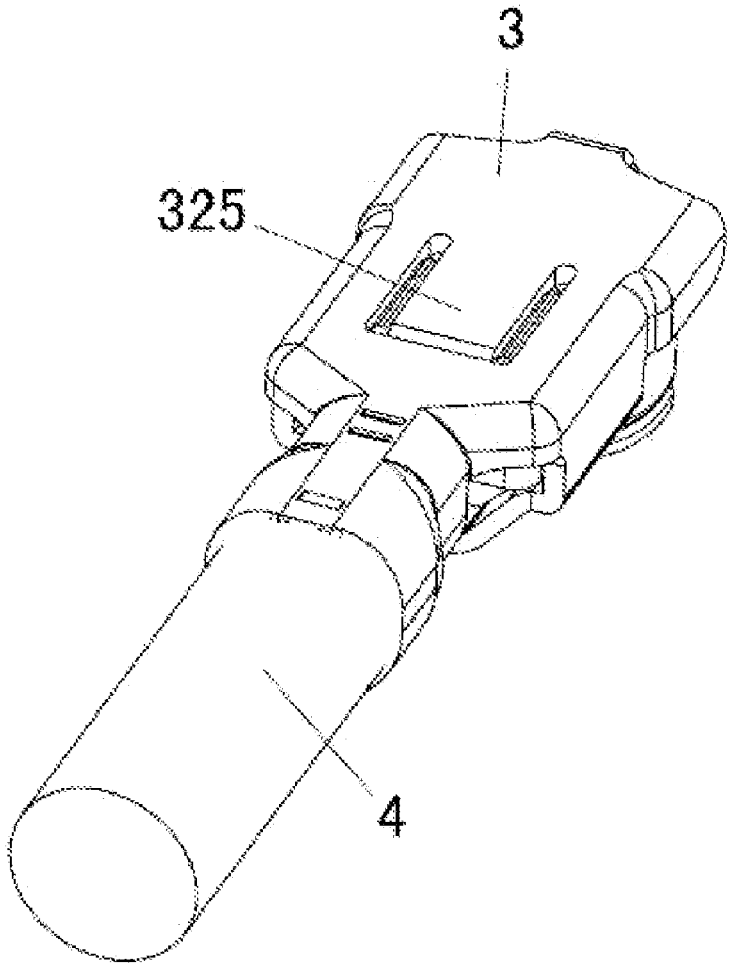
FIG. 8 is a structural representation view of the cover plate after bending it.

Please refer to FIG. 3 and FIG. 4, the shielding shell 3 is formed by once stamping from a sheet metal, it includes a main body 31, a flat portion 32 connected to the main body 31 and a wire holder on the rear end of the flat portion 32, FIG. 3 shows the unbend state of the main body 31 with material belt, FIG. 4 shows the condition of the main body 31 having been bent to the flat portion 32. Unless specified otherwise, the delineation of the present invention is based on the precondition of the main body 31 having being bent.

The main body 31 has a shape of a column, a receiving hole 311 for receiving the cylinder portion 11 of the insulating housing 1, a pair of holding arms 312 extend perpendicular to the longitudinal direction of the main body 31 from both bottom sides of the main body, the tail portion of the holding arms 312 turned inward and formed a block portion 313, it can prevent the insulating housing from moving forward. There are two notches 314 on the bottom of the main body 31, two notches 314 can match the two projecting portions 114 of the insulating housing 1 tightly.

The flat portion 32 has a front end 321 and a back end 322, the front end 321 is slightly wider than the back end 322, the front end 321 can receive the cylinder portion 11 and support the main body 31 after the main body 31 having been bent toward to the flat portion 32. The flat portion 32 also includes retention latches 323 that extend from the rear bottom end of the front end 321 opposite each other to prevent the main body 31 from moving. The back end 322 can receive the holding arms 312 of the main body 31 and the receptacle housing 12 of the insulating housing 1. There is a cavity 324 formed in the center of the back end 322 corresponding to the through hole 121 of the insulating housing 1 through bending over a cover plate 325. The cover plate 325 can seal the cavity 324 for further reducing Electromagnetic Interference (EMI). A pair of side arms 326 extend and bend vertically from the back end 322, and the side arms 326 cover the holding arms 312 tightly from outside and combine the ribs 323 of the front end 321 into a whole for extra strength for the flat portion 32, these pair of side arms 326 extend over and form two bending arms 327. The bending arms 327 formed a "Z" shape and can bend inward to cover the insulating housing 1 and the holding arms 312 from outside. The inclined plane 328 in the middle of the bending arms 327 can match the sloping surfaces 123 of the insulating housing 1, but the others both sides of the bending arms 327 is flat. The advantage of this design is, when a central conductor 41 with a larger diameter connect to the wire holder 22, it will need to increase the height of the receptacle housing 12, this structure can decrease the consumption of insulating material. If we don't need to increase the height of receptacle housing 12 of a coaxial connector, the inclined plane 328 is not necessary. The wire holder is formed at the other end of the back end 322 including a first wire holder 33 and a second wire holder 34. There are ribs on the first and the second wire holder to further strengthen the holding force of the wire holder for the cable.

Please refer to FIG. 1, FIG. 5, FIG. 6, FIG. 7, and FIG. 8, the assemble process of this coaxial connector 100 includes following steps:

Step one: Provide an insulating housing 1 and central terminals 2 form a docking assembly through insert molding or assembly, produce a shielding shell 3 with a sheet metal by once stamping (shown in FIG. 3), and prepare a section of a coaxial cable 4 having been stripped, then assemble the docking assembly into the shielding shell 3 in advance, then the product becomes a half-finished coaxial connector, the cylinder portion 11 is assembled into the main body 31 of the shielding shell 3, the receptacle housing 12 set on the flat portion 32 of the shielding shell 3 (shown in FIG. 5);

Step two: Match the sheet metal with half-finished coaxial connector with machine by position hole formed on the material belt, set the half-finished coaxial connector in place in the mold, then put the section of a coaxial cable 4 having been stripped in position in the half-finished coaxial connector, the central conductor 41 of the coaxial cable 4 is retained in the wire holder 22 of the central terminal 2, the second layer 43 which surrounding the first layer 42 concentrically is retained in the second wire holder 33, and the third layer 44 which surrounding the second layer 43 concentrically is retained in the third wire holder 34.

Step three: Hold and lock the central conductor 41 of the coaxial cable 4 which retained by the wire holder 22 by compression joint process. Then the central terminal 2 holds and locks the central conductor 41 firmly and provides a stably electric connection between the central terminal 2 and the coaxial cable 4.

Step four: Bend the bending arms 327 of the flat portion 32 inwards form the border of the side arms 326, so as to cover the docking assembly from outside, and prevent the docking assembly from moving in the shielding Shell 3.

Step five: Hold and lock the second layer 43 and the third layer 44 of the coaxial cable 4 with the first wire holder 33 and the second wire holder 34 respectively by compression joint process, so as to prevent the coaxial cable 4 from moving, and further strengthen the holding force of the wire holder 22 at the central conductor 41.

Step six: Bend the cover plate 325 to seal the cavity 324.

After following the above steps, then remove the material belt, we get a high precision coaxial connector 100. Above mentioned assembly processing steps are performed by assembly machine, and we can also use other assembly methods to achieve a same result or get the same product. Besides, the order of same of the steps can be changed, and same of the steps can be performed at the same time.

The structure of the once molding shielding shell 3 with a cavity 324 will help to simplify the mold structure and the assembly process of the coaxial connector 100, and also it will help to reduce the cost and the defect rate of the product. In other embodiment of the present invention, the cavity 324 can be a pure cavity without a cover plate 325 covering it, we can use other methods to cover it, for example, we can use a patch to cover the cavity 324, or we can stopple it with a stopper.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. A coaxial connector comprising:

an insulating housing including a cylinder portion and a receptacle housing connected to the cylinder portion;

a central terminal having a contact received in the cylinder portion and a wire holder received in a through hole of the receptacle housing;

a shielding shell including a main body, a flat portion connect to the main body and a shell wire holder on the rear end of the flat portion, wherein there are a pair of holding arms on the bottom of the main body, the flat portion includes a front end and a back end, a pair of side arms extend form the both side of the back end vertically, two bending arms extend from the two side arms respectively, the bending arms bent inward to cover the insulating housing and the holding arms from outside, and there is a cavity formed in the back end corresponding to the through hole of the receptacle housing;

wherein there are inclined planes formed on bending arms;

wherein there is a sloping surface formed on the receptacle housing at one side of the through hole and the inclined plane matches on the sloping surface when the bending arms are bent inward to cover the receptacle housing of the insulating housing and the holding arms.

2. The coaxial connector as recited in claim 1, wherein the tail portion of each of the holding arms turns inward to form a block portion, which can prevent the insulating housing from moving forward.

3. The coaxial connector as recited in claim 1, wherein the front end receives the cylinder portion and support the main body after the main body being bent toward to the flat portion.

4. The coaxial connector as recited in claim 1, wherein a cover plate is formed through bending over a piece of the back end of the flat portion, and the cover plate can seal the cavity for further reducing electromagnetic interference (EMI).

5. The coaxial connector as recited in claim 1, wherein the side arms of the back end combine ribs of the front end into a whole for extra strength for the flat portion.

6. The coaxial connector as recited in claim 1, wherein the shell wire holder at least includes a first shell wire holder and a second shell wire holder.

7. The coaxial connector as recited in claim 1, further comprising a patch to cover the cavity.

8. The coaxial connector as recited in claim 1, further comprising a stopper to stopple the cavity.

* * * * *